US005362430A

United States Patent [19]

Herold, II et al.

[11] Patent Number: 5,362,430

[45] Date of Patent: Nov. 8, 1994

[54] AQUEOUS-QUENCH SPINNING OF POLYAMIDES

[75] Inventors: John H. Herold, II, Hendersonville, Tenn.; Henry Kobsa, Greenville, Del.

[73] Assignee: E. I. Du Pont de Nemours and Company, Wilmington, Del.

[21] Appl. No.: 90,291

[22] Filed: Jul. 16, 1993

[51] Int. Cl.[5] ..... D01D 5/08; D01D 5/088; D01F 6/60

[52] U.S. Cl. ..... 264/103; 264/178 F; 264/210.8; 264/211.14

[58] Field of Search ..... 264/103, 178 F, 210.8, 264/211.14, 211.15, 211.17

[56] References Cited

U.S. PATENT DOCUMENTS

| | | | |
|---|---|---|---|
| 2,243,397 | 7/1943 | Hull | 264/180 |
| 3,002,804 | 10/1961 | Kilian | 264/181 |
| 3,621,088 | 11/1971 | Hatcher et al. | 264/178 F |
| 3,944,708 | 3/1976 | Dumas | 428/400 |
| 4,970,042 | 11/1990 | Kakiuchi | 264/177.13 |
| 4,983,448 | 1/1991 | Karageorgiou | 428/224 |

FOREIGN PATENT DOCUMENTS

| | | |
|---|---|---|
| 803237 | 10/1958 | United Kingdom . |
| WO91/18133 | 11/1991 | WIPO . |

*Primary Examiner*—Leo B. Tentoni

[57] ABSTRACT

Molten polyamide filaments are extruded from spinneret capillaries through a gas-filled gap and into a quench bath which contains a heated aqueous liquid. The bath has a nozzle defining a vertically disposed cylindrical passageway with its entrance in the bath below the bath surface. The filaments are converged into a filament bundle at the entrance and withdrawn from the exit of the passageway at a withdrawal speed of about 1500 to about 3500 meters per minute. The polyamide polymer is extruded from the spinneret such that the jet velocity in the spinneret capillaries is between 2 and 10% of the withdrawal speed of the filament from the exit of the nozzle passageway.

9 Claims, 1 Drawing Sheet

AQUEOUS-QUENCH SPINNING OF POLYAMIDES

BACKGROUND OF THE INVENTION

Polyamide yarns for textile and carpet end-uses are typically melt-spun, quenched in air, and drawn after the yarn is quenched. The drawing step requires a number of draw rolls and related drive and control systems which increases the complexity of the spinning machine and the manufacturing process. While it is possible to use processes in which the yarn is spun at sufficiently high speeds so that a "fully-drawn" yarn can be made without a drawing step, sophisticated equipment is needed and the desired yarn properties are difficult to achieve. The present invention permits the use of simpler spinning machines which take up less floor space. Also, because of less tension on the threadline, fewer breaks and higher yields can be expected.

SUMMARY OF THE INVENTION

In accordance with the invention, a novel process is provided which can produce a "fully-drawn" polyamide yarn without the need for drawing. The process includes extruding molten polyamide from spinneret capillaries through a gas-filled gap and into a quench bath which contains an aqueous liquid at a temperature of at least 45° C. Below the surface of the bath is a nozzle defining a cylindrical passageway disposed in a generally vertical position with entrance opening in the bath. The filaments are converged into a bundle at the entrance to the nozzle passageway and are removed from the bath at the other end of the passageway along with entrained bath liquid. The filament bundle is withdrawn from the bath at a speed of greater than about 1500 and less than about 3000 meters per minute (m/min). The ratio of the withdrawal speed (m/min.) of the filament bundle from the exit of the nozzle passageway to the jet velocity, that is, the draw-down ratio, should be from 10 to 50.

DETAILED DESCRIPTION

Polyamide as used in this application refers to any of the various generally linear, aliphatic homo- and copolyamides which are typically melt-spinnable and which yield fibers having properties suitable for the intended application. For this invention, poly(hexamethylene adipamide) (6,6 nylon) and poly(ϵ-caproamide) (6 nylon), and their copolymers are useful. Preferably, polymers comprising at least about 85 wt % poly(-hexa-methylene adipamide) are used, with poly(hexamethylene adipamide) (6,6 nylon) being most preferred.

Figure 1:
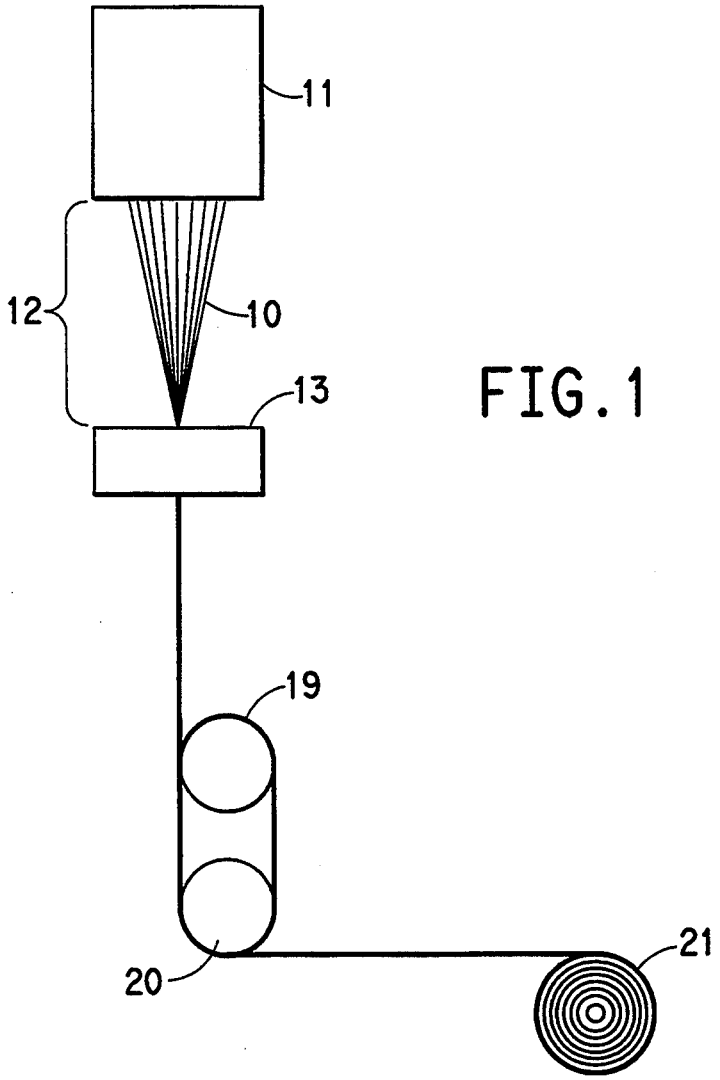
FIG. 1 is a schematic elevational view of a process in accordance with the present invention.
Figure 2:
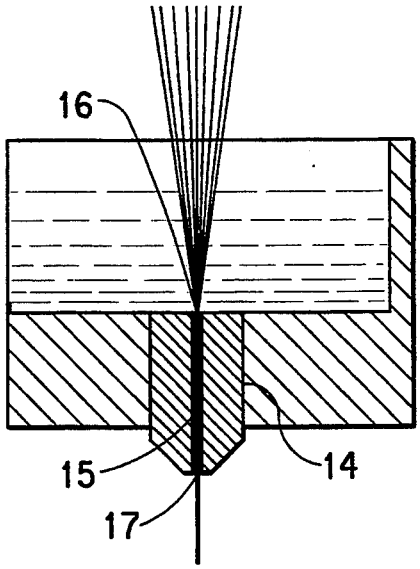
FIG. 2 is a schematic side view of quenching apparatus useful in a process as illustrated in FIG. 1.

Referring to FIG. 1, polyamide filaments 10 are extruded from a spinneret 11 through a gas-filled (preferably air) gap 12 and into a quench bath 13 containing an aqueous liquid. As shown in FIG. 2, a nozzle 14, situated below the surface of the bath, defines a cylindrical passage 15 disposed in a generally vertical position with entrance 16 opening into the bath and exit 17 at the other end of the passageway outside the bath. Cylindrical passage 15 should have a cross-sectional area sufficient to accommodate the filament bundle and entrained bath liquid but it should not be so great as to allow excessive loss of bath liquid. Supplementary aqueous quench liquid, preferably water, is fed into the quench bath through inlet means not shown to make up for loss through the exit nozzle. Filaments 10 are converged into a filament bundle at entrance 16 of passageway 15, and leave at exit 17 together with entrained bath liquid. Referring back to FIG. 1, the filaments are withdrawn from quench bath 13 and are wrapped around feed rolls 19 and 20 before being wound up on wind-up roll 21.

Spinning conditions, as will be understood by those skilled in the art, should be selected to minimize periodic denier variations in the fibers and/or fiber breakage. This may be caused by improperly coordinated jet velocity, polymer temperature, relative viscosity and size of the gas-filled gap and draw-down ratio. The draw-down ratio as used herein is defined as the ratio of the speed of filament bundle withdrawal from the exit of the nozzle passageway (measured as the surface speed of the feed rolls), to the jet velocity of the polymer through the spinneret capillaries. Jet velocity is readily calculated by dividing the total volume of polymer passing through the spinneret (cc/min) as determined by the pump speed, by the total cross-sectional area ($cm^2$) of the spinneret orifices.

The filament bundle is withdrawn from the exit of the nozzle passageway at a speed preferably between about 1500 to about 3500 m/min and more preferably between about 1500 to about 3000. Withdrawal speed also referred to herein as spinning or feed roll speed, of less than about 1500 m/min. results in yarn that is inadequately drawn and has undesirably high elongation. Withdrawal speeds of greater than about 3500 m/min. result in over-drawn yarn having undesirably low elongation and toughness. Generally, elongations of less than about 70 % in bulked continuous filament yarns suitable for carpet yarn and less than about 40% in textile yarns are desirable. Either or both the jet velocity and the withdrawal speed should be adjusted so that the draw-down ratio falls between about 10 and 50.

The relative viscosity (RV) of the polyamide to be spun is preferably between about 45–50. Below about 40 RV the operable window narrows and at much above 50 RV, pack pressure can become a problem.

The gas-filled gap is preferably an air gap, however, steam may also be used. The length of the gas-filled gap should be set to give fiber of the desired physical properties. Preferably, the gap length is between about 5 cm to about 20 cm. Threadline tension decreases with increasing gap length and this sets upper and lower bounds on operable gap lengths. For example, when spinning 19 dpf (21 dtex/filament) 6,6 nylon yarns at 2000 ypm (1830 m/min) from a spinneret with capillaries placed on three concentric circles with 2.1, 1.8, and 1.5 in (5.3, 4.6, and 3.8 cm, respectively) diameter, the longest operable gap lengths were about 20 cm. At about 25 cm, the threadline tension was too low, and the filaments started to touch each other and stick together. During string-up, the quench bath was raised to within about four inches of the spinneret to break the bundle apart. Once the bundle was opened, the filaments remained separate as long as the gap length was kept at 20 cm or less.

It is important that the filaments be solidified before the threadline converges. If two filaments have touched and are stuck together, as during string-up, they should be separated. However, once they are separated, only enough force to keep them from wandering about is required to keep them separated. Experiments with different quench bath geometries have shown that the filaments solidify at about 2.5 cm or more beneath the surface of the quench bath.

Although quantitative measurements of thread-line tension in the gap were not made, the increase in tension as the gap length is decreased is visually apparent. At large gap lengths, tension is lost completely and the filaments fall straight down into the quench bath. As the gap length decreases, enough tension is developed to cause the filaments to converge at the entrance to the nozzle in the quench bath. The preferred situation is to have just enough tension for this to happen. At this point, the attenuation of the filaments above the quench bath is only modest. Further decreases in gap length lead to further increases in tension and to marked attenuation of the filaments above the quench bath. Visual observation reveals that at very small gap lengths most of the attenuation occurs above the quench bath.

Generally, the largest operable gap lengths are preferred because they yield the best physical properties. As the gap length decreases, both tenacity and elongation decrease. Usually, there is little loss of tenacity until the gap length drops below about 15 cm. The preferred gap length varies with the filament denier. In general, gap lengths of about 5 to about 20 cm are preferred. For continuous filament yarns (dpf of about 15–25; 17–28 dtex/filament), gap lengths of 10–15 cm offer the best balance of process stability and physical properties. With textile yarns (dpf of about 1.5–6; 1.7–6.7 dtex/filament), loss of tension occurs at smaller gap lengths, i.e., about 10 cm, and the preferred operating range is 5–8 cm.

The aqueous quench liquid is preferably water. Addition of a finish composition to the quench bath obviates the need for applying a finish later in the process, and is desirable to prevent yarn damage during processing. In general, dilute finish compositions improve operability considerably. Hydrophilic finish compositions containing ethoxylated components are suitable for use in the current process. Surfactants in conjunction with an antifoaming agent were also found to give excellent results. Other additives such as dyes, reserving agents, antisoil compositions or the like may also be added to the quench bath.

The temperature of the quench bath is an important variable. Temperatures of from about 45° C. to a temperature less than the boiling point of the aqueous quench liquid give acceptable fiber properties. Yarns quenched in 25° C. water had poor physical properties (tenacity $<1.0$ gpd (0.88 dN/tex)). Increasing the temperature of the quench bath resulted in significantly improved physical properties. Temperatures of about 85° to 95° C. are preferred, especially if yarns having high dye rates are desired. It is important that the bath temperature be maintained approximately constant to obtain yarns having uniform properties.

The depth of the quench bath, that is, the distance from the entrance 16 of the nozzle passageway to the surface of the quench bath, is preferably about 2 to about 5 cm. Reducing the depth of the quench bath improves tenacity and elongation slightly, but reduces filament spacing at the bath surface, thus making it more difficult to keep the filaments from sticking together. There is no need to increase the bath depth beyond that which is necessary to keep the filaments from sticking to each other. The tension on the filaments increases with increasing bath depth, resulting in reduced filament properties.

The vertically-mounted nozzle situated at the bottom of the quench bath or at least beneath the surface of the bath provides a passageway through which the threadline exits from the quench bath. The nozzle passageway is preferably cylindrical and smooth to develop a favorable flow pattern. A non-round passageway causes irregular flow patterns which leads to stuck filaments. The entrance to the nozzle passageway is preferably rounded off to prevent abrasion damage to the filaments. The exit preferably is a knife edge with the nozzle wall cut back at about a 45 degree angle so the quench fluid traveling with the threadline separates cleanly from the nozzle. A stripper jet may be used after the quench bath to reduce the water content of the threadline before winding up the yarn.

The diameter of the nozzle passageway and the depth of the quench bath are preferably such that the tension on the filament bundle exiting the nozzle and as measured at the feed rolls is between about 2 and about 6 g/filament. If the diameter is too large, too much water travels with the threadline. Since the water is eventually accelerated to the withdrawal speed, the threadline tension becomes excessive and the yarn is over-drawn and may be broken. On the other hand, if the diameter is too small, the threadline is choked off and the device cannot be strung up. For yarns having a bundle denier of about 1440 dtex, a passageway diameter of about 5/32 inch (4.0 mm) is preferred. For textile yarns having a bundle denier of about 40 (44 dtex), a 1/16 inch (1.6 mm) diameter is useful.

The length of the nozzle passageway is not as important as its diameter. Lengths as short as ⅛ inch (3 mm) and as long as 6 inches (15 cm) gave acceptable results. Very short lengths give somewhat inferior yarns and very long nozzles are awkward to handle.

TEST METHODS

In the examples, the stated denier values are nominal deniers. Physical properties were measured on relaxed yarns whose denier were a few percent higher.

Yarn uniformity was determined with the use of a capacitance-type evenness tester. This apparatus gives a measure of the evenness of the yarn in terms of the percent coefficient of variation, CV, which is equivalent to 100 times the standard deviation of successive denier determinations divided by the mean. Values reported herein were determined on a Uster evenness tester, Model B, equipped with a quadratic integrator, using the manufacturer's procedure for the measurement. The higher the value of CV, the poorer the yarn evenness. Two measurements are made, corresponding to very short range evenness (corresponding to 0,076 cm or 0.03 inch cut length) and long range evenness (corresponding to 549 cm or 216 inch cut length).

Polymer RV was measured according to the procedure described in U.S. Pat. No. 3,511,815. Yarn tenacity, or normalized breaking load, elongation and modulus were determined by ASTM Method D-2256-80, using a tensile testing machine meeting the standards of the method (Instron Model 1122, Instron Engineering Corp., Canton, Mass.). Pneumatic action snub-nosed grips were used. Tests were run at 60% elongation/minute. Tenacity values reported herein were determined using samples having a gage length of 10 inches and a twist of 3 turns/inch. The yarns were conditioned at 65% relative humidity and 70 degrees C. prior to testing.

EXAMPLE I 43.6 RV nylon 6,6 was spun through an air gap into a quench bath to produce 133 denier 19 dpf (21 dtex/filament) yarns using a process as illustrated in FIG. 1.

A spinneret with 7 trilobal capillaries in about a 25.4 mm circular arrangement was used. The capillaries had a cross-sectional shape which can be described as three slots with semi-circular ends with the width of the slots being 102 μm, the length of the straight section being 152 μm, and the total cross-sectional length was 203. The capillary length was 127 μm. A long countersink, 40 degree included angle, 1.27 m long, was provided as a precaution against melt fracture. The cross-sectional area of each capillary is 0.0588 $mm^2$.

The nozzle associated with the quench bath defined a passageway that was 3.2 mm in diameter and 25 mm long. The depth of the bath above the entrance to the nozzle passageway was 13 mm. The quench liquid was water at a temperature 90° C. The distance from the spinneret to the surface of the water (the gap) was 152 mm. An interlace jet operating at an air pressure of 50 psig was used to reduce the water content of the threadline exiting the quench bath.

Items A–D were made at the speeds described in Table 1. The draw-down was 31.7 for all items.

TABLE 1

| Item | Feed Roll Speed m/min | Computed Jet Velocity (m/min) | T g/den | T (dN/tex) | E % | M g/den | M (dN/tex) | Toughness g/den | Toughness (dN/tex) | CV % |
|---|---|---|---|---|---|---|---|---|---|---|
| A | 1829 | 57.5 | 3.01 | (2.66) | 52 | 18.9 | (16.7) | 0.94 | (0.83) | 0.98 |
| B | 2286 | 72.1 | 2.28 | (2.01) | 38 | 19.4 | (17.1) | 0.55 | (0.49) | 4.55 |
| C | 2743 | 86.5 | 1.76 | (1.55) | 27 | 18.7 | (16.5) | 0.32 | (0.28) | 1.04 |
| D | 3200 | 100.9 | 1.57 | (1.39) | 24 | 18.2 | (16.1) | 0.26 | (0.23) | 1.26 |

Each set of physical properties of the yarns represents the average of three measurements. The gradual loss of tenacity, elongation, and toughness with increasing speed is evident. The high Uster value of item B is unexplained.

EXAMPLE II

The same spinneret was used to spin 50 RV nylon 6,6 into 133 denier, 19 dpf, at a constant 1829 m/min spinning speed, but with varying air gaps. The quench bath temperature was about 85° C. Items A–E were made using the air gaps indicated in Table 2.

TABLE 2

| Item | Air gap mm | T g/den | T (dN/dtex) | E % | CV % |
|---|---|---|---|---|---|
| A | 203 | 2.81 | (2.48) | 51 | 3.15 |
| B | 152 | 2.49 | (2.20) | 46 | 3.05 |
| C | 102 | 2.43 | (2.14) | 50 | 1.75 |
| D | 51 | 2.01 | (1.77) | 43 | 2.19 |
| E | 25 | 1.64 | (1.45) | 41 | 2.83 |

There is gradual loss of physical properties as the air gap gets smaller. Uniformity is best at intermediate air gaps where there is some, but not too much, tension.

EXAMPLE III

Using the same spinneret and the same polymer as in Example II, a series of yarn with varying dpf (and corresponding denier) were spun using a spinning speed of 1829 m/min and an 152 mm air gap. Items A–D were made with the dpf indicated in Table 3.

TABLE 3

| Item | Dpf | T g/den | T (dN/dtex) | E % | CV % |
|---|---|---|---|---|---|
| A | 19 | 2.49 | (2.20) | 46 | 3.05 |
| B | 34 | 2.19 | (1.93) | 53 | 1.85 |
| C | 55 | 1.75 | (1.54) | 61 | 2.11 |
| D | 80 | 1.18 | (1.04) | 57 | 1.99 |

Item A with a draw-down of 31.7 still has a trace of draw resonance which explains the higher CV. The other three items all have lower draw-down (by the ratio of their dpf to 19) and show no signs of draw resonance.

EXAMPLE IV (Comparative Example)

Item C of Example II was repeated with a different spinneret. The width of the slots was 254 μm. The length of the straight portion was 371 μm. The total length of the slots was 498 μm. The area of the capillary was 0.36 $mm^2$. The computed jet velocity was 9.4 m/min. The draw-down was 195. This item had 3.95% CV and showed a pronounced draw resonance with a wave length of about 10 m. The use of smaller capillaries could avoid draw resonance.

EXAMPLE V

A textile yarn with a nominal denier of 123 was spun using a process and apparatus as illustrated in FIG. 1.

The spinneret had 34 holes on two concentric circles with 25 and 33 mm diameter. The capillaries had a circular cross-section and were 89 μm in diameter and 279 μm long. The jet velocity was 104 m/min and the draw-down 17.6. The quench water temperature was 85° C. and the air gap was 7.6 cm. The feed roll speed was 1829 m/min.

The resulting relaxed yarns were 134 denier and had 3.53 gpd tenacity, 55% elongation, 23.4 gpd modulus, and 1.30 gpd toughness. Re-testing gave 3.74/62/21.9/1.54 and 3.56/60/22.3/1.48. Uster CV was 5.2%.

Feed roll speed was increased to 2286 m/min without changing pump speed. This decreased nominal denier to 98, and increased draw-down to 22.0. Relaxed yarns were 108 denier and had 3.42 gpd tenacity, 40% elongation 24.4 gpd modulus, and 0.91 gpd toughness. Re-testing gave 3.90/47/24.2/1.22 and 3.72/44/23.4/1.07. Uster CV was 1.5% with no evidence of draw resonance.

Feed roll speed was further increased to 2743 m/min without changing pump speed. This decreased nominal denier to 82, and increased draw-down to 26.4. Relaxed yarns were 91 denier and had 3.67 gpd tenacity, 32% elongation 23.4 gpd modulus, and 0.77 gpd toughness. Re-testing gave 3.86/35/25.1/0.89 and 3.83/37/26.6/0.97. Uster CV was 1.6%.

What is claimed is:

1. A process for preparing polyamide yarn comprising:

extruding molten polyamide into filaments from spinneret capillaries at a given jet velocity, passing the molten filaments through a gas-filled gap and into a quench bath which contains an aqueous liquid at a temperature of at least 45° C., there being associated with said bath, a nozzle defining a cylindrical passageway disposed in a generally vertical position and with its entrance opening into the bath, converging said filaments into a filament bundle at the entrance to the nozzle passageway and removing said filament bundle from the bath through the other end of said passageway at a withdrawal speed of greater than about 1500 than about 3000 m/min, the ratio of said withdrawal speed to the jet velocity being from 10 to 50, thereby forming polyamide yarn.

2. The process of claim 1 wherein said gas-filled gap is an air gap.

3. The process of claim 2 wherein said filaments travel a distance from about 5 cm to about 20 cm through said air gap.

4. The process of claim 1 wherein said quench bath is water.

5. The process of claim 4 wherein said water temperature is from about 85° to about 95° C.

6. The process of claim 1 wherein the distance between the entrance to the nozzle passageway and the surface of the bath is from about 2 to 5 cm.

7. The process of claim 1 wherein said nozzle passageway has a diameter between about 1.5 mm to about 4 mm.

8. The process of claim 1 further comprising stripping residual quench liquid from said filament bundle and winding the filament bundle into a package.

9. The process of claim 1 wherein said polyamide comprises poly(hexamethylene adipamide).

* * * * *